United States Patent [19]

Dickerson, Jr. et al.

[11] Patent Number: 4,668,454

[45] Date of Patent: May 26, 1987

[54] HEAT-STRENGTHENING PROCESS

[75] Inventors: Wilton H. Dickerson, Jr.; Che-Hsiung Hsu; Michael R. Samuels, all of Wilmington, Del.

[73] Assignee: E. I. Du Pont de Nemours and Company, Wilmington, Del.

[21] Appl. No.: 743,903

[22] Filed: Jun. 12, 1985

[51] Int. Cl.[4] ..... B05D 1/00

[52] U.S. Cl. ..... 264/129; 264/211.17; 264/234; 264/235; 264/345; 264/346; 427/434.6

[58] Field of Search ..... 264/345, 129, 210.3, 264/211.17, 346, 234, 235; 429/172, 174; 427/434.6

[56] References Cited

U.S. PATENT DOCUMENTS

| | | | |
|---|---|---|---|
| 4,083,829 | 4/1978 | Calundann et al. | 528/193 |
| 4,118,372 | 10/1978 | Schaefgen | 528/190 |
| 4,153,779 | 5/1979 | Jackson, Jr. et al. | 528/193 |
| 4,183,895 | 1/1980 | Luise | 264/345 |
| 4,412,058 | 10/1983 | Siemionko | 528/193 |
| 4,424,184 | 1/1984 | Eskridge et al. | 264/235 |

FOREIGN PATENT DOCUMENTS

| | | | |
|---|---|---|---|
| 0065417 | 6/1978 | Japan | 264/210.3 |
| 0114919 | 10/1978 | Japan | 264/210.3 |
| 2079182 | 1/1982 | United Kingdom | 427/172 |

*Primary Examiner*—Jan H. Silbaugh
*Assistant Examiner*—Hubert C. Lorin

[57] ABSTRACT

Use of surfactant in coating of yarn from anisotropic melt-forming polyester with alkali metal salts enhances heat-strengthening acceleration effect.

4 Claims, No Drawings

HEAT-STRENGTHENING PROCESS

BACKGROUND OF THE INVENTION

1. Field of the Invention

This invention relates to improving the strength of yarn spun from anisotropic melt-forming polyesters.

2. Description of the Prior Art

A class of wholly aromatic polyesters that form optically anisotropic melts from which oriented filaments can be melt spun has been described in Schaefgen U.S. Pat. No. 4,118,372. Most polyesters which are disclosed in this patent are derived primarily from para-oriented dihydric phenols and para-oriented dicarboxylic acids. U.S. Pat. No. 4,083,829 discloses polyesters consisting essentially of p-oxybenzoyl moieties, 2,6-dicarbonylnaphthalene moieties and various other moieties. These are also said to exhibit anisotropy in the melt. Still other anisotropic melt-forming polyesters are disclosed in U.S. Pat. No. 4,153,779 and in many other patents and publications. These polymers are also described as liquid crystal or thermotropic polymers.

It has been taught by Luise U.S. Pat. No. 4,183,895 that yarn which has been spun from anisotropic melt-forming polyesters may be strengthened by heat-treatment and this has been acknowledged in U.S. Pat. No. 4,083,829 and in other patent literature. Quite often it is found that the yarns must be heat-treated for extended periods in order to achieve significant improvement in tenacity.

The use of alkali metal salts as accelerators for the heat-strengthening process is taught in Eskridge et al U.S. Pat. No. 4,424,184. According to the process of that patent, the yarns are coated with small amounts of the salts prior to heat-strengthening. By virtue of the present invention, one can enhance the effect of the accelerator.

SUMMARY OF THE INVENTION

The present invention is directed to an improvement in the process whereby yarn spun from anisotropic melt-forming polyesters is heated at temperatures above 250° C. for periods sufficient to increase tenacity by at least 50%. It is now known that the heat-strengthening process is accelerated by coating the yarn prior to such heat-treatment with a small amount of an alkali metal salt, preferably an alkali metal halide. Such compounds are normally applied as solutions. In accordance with the present invention, a surfactant is incorporated in such solutions to lower the surface tension of the solution. Use of the surfactant has been found to make the acceleration more effective. Alternatively, the coating composition may comprise a solution of a surfactant which contains the alkali metal ion and which performs both functions—accelerator and surfactant.

DETAILED DESCRIPTION OF THE INVENTION

The yarns that are heat-treated according to this invention are composed of as-spun oriented filaments obtained by the melt-spinning of optically anisotropic melt-forming polyesters. These polyesters are aromatic polyesters of the type shown and generically described in U.S. Pat. No. 4,424,184. The process of this invention is believed to be broadly applicable to such as-spun oriented polyester filaments.

The conditions of heat-treatment employed are fully described in U.S. Pat. No. 4,183,895. The yarn is heated, preferably while essentially free of tension and in an inert atmosphere. Generally the atmosphere surrounding the yarn during heat-treatment is purged with nitrogen; however, vacuum may be applied for at least part of the treatment. The yarn should be maintained in a substantially relaxed condition during heat-treatment. There is no advantage in holding the yarn under tension and it is generally undesirable to do so. It is often found that some shrinkage takes place during heat-treatment and that the yarn will break if it is not free to contract. In addition, fusion between filaments may occur if the yarn is wrapped tightly around an unyielding bobbin.

It has been the practice to heat treat the yarn at temperatures above 250° C. in order to obtain a marked improvement in tenacity, e.g., at least 50% greater than the as-spun tenacity. The heating periods and temperatures employed will vary somewhat depending on the particular yearn polymer. To minimize fusion between filaments one would not normally exceed the flow temperature of the polymer in the yarn. It has been found that yarns of polymers with flow temperatures below about 250° C. require undesirably long periods of heat-treatment and are less preferred.

The application of accelerators has been shown in U.S. Pat. No. 4,424,184 to diminish the time required to reach desirable tenacity levels. This in turn reduces the investment capital needed for manufacture of such fibers. The resulting fibers are useful in fiber/plastic composites providing strength with reduced weight compared to steel and also are useful in rubber reinforcement as in tires or belts.

The heat strengthening accelerators which may be used in this invention include the alkali metal halides preferred by Eskridge et al in U.S. Pat. No. 4,424,184 as well as other inorganic or organic salts of the alkali metals. While the particular salt selected is not critical, one should avoid the use of such salts which have a deleterious effect on the yarn regardless of whether the salt acts as an accelerator.

The heat strengthening accelerators are normally applied from aqueous solution as taught in U.S. Pat. No. 4,424,184. In accordance with the present invention, there is incorporated in the solution a surfactant in an amount sufficient to completely wet the fiber. The surfactant reduces the surface tension of the solution and is believed to more uniformly spread the accelerator over the surface of the filaments. Scanning electron microscopy shows that smaller salt crystals are spread more evenly with the invention as compared with large salt crystals distributed sporadically on the filament surface. It is also postulated that the residue of the surfactant provides a tacky surface which aids in preventing the salt crystals from falling off the yarn as the coating dries.

As useful surfactants there may be mentioned the nonionic surfactants such as octylphenoxypolyethoxyl ethanol (Triton ®X-100) of the formula

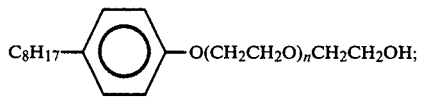

$C_8H_{17}$—⟨○⟩—$O(CH_2CH_2O)_nCH_2CH_2OH$;

nonylphenoxy polyethoxy ethanol (Igepal ®CO630) of the formula

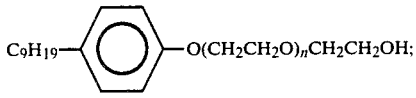

fatty alcohol-ethylene oxide condensation product (Alkanol ®OJ) or the fluorinated surfactant (Zonyl ®FSN). Ionic surfactants such as Aerosol ®-OT, dioctyl sodium sulfosuccinate, may also be used. Since this surfactant contains the alkali metal, it would be expected to serve as both an accelerator of the heat strengthening process and as a surfactant.

The accelerator salt and surfactant or the surfactant itself if it contains the alkali metal ion may be applied to the yarn in solution with or without other ingredients such as yarn finish or lubricant. The yarn may be dipped in the solution or may pick up solution by passage over a roller in contact with the solution. Other application techniques will be obvious to those skilled in the art.

Testing Procedures

Yarn tensile properties are determined by techniques described in U.S. Pat. No. 4,424,184 except for gauge length which was 5 in. (12.7 cm.).

EXAMPLES 1–4

A 10-filament yarn of about 60 denier was spun from an optically anisotropic melt copolyester from the following reactants—chlorohydroquinone (40 mol %), 4,4-dihydroxydiphenyl (10 mol %), terephthalic acid (40 mol %) and isophthalic acid (10 mol %) as described in U.S. Pat. No. 4,412,058. Samples of the yarn were immersed in selected solutions containing 1% by weight KI and 0.1% by weight of various surfactants (see Table I) dissolved in deionized water. Control samples were made by immersing the yarn in a 1% KI solution without surfactant and in surfactant solutions without alkali metal salt accelerators. After the yarns were soaked for ~20 minutes they were withdrawn from the solutions and allowed to dry at room temperature.

The heat strengthening was carried out in a 3.0 meter tube oven as described in Example 5 of U.S. Pat. No. 4,424,184. The sample yarns were placed on a continuous glass-fiber belt and moved through the tube oven with about a 45 minute residence time. The oven was continuously purged with nitrogen flowing at about 0.3 SCF/min. A typical temperature profile, determined by use of thermocouples spaced about 30 cm apart starting 30 cm within the oven from the entrance, was 178°, 240°, 270°, 284°, 294°, 300°, 299°, 302° and 295° C. at the set temperature used for this experiment.

The yarn which was treated with KI solution containing surfactant showed a marked improvement in tenacity over the control yarns without surfactant (see Table I). Observation of the dried KI-treated fiber surface in a scanning electron microscope showed that when surfactant is used with the KI solution, the KI is uniformly distributed.

TABLE I

| Example | Coating Solution (w/w %) | Heat Strengthened Yarn Properties T/E/M (gpd/%/gpd) |
|---|---|---|
| — | 1% KI in deionized water | 9.6/1.9/505 |
| — | 0.1% Triton ® X-100 | 4.3/1.3/293 |
| 1 | 1% KI, 0.1% Triton ® X-100 | 21.4/3.3/527 |
| — | 0.1% Igepal ® CO630 | 5.6/1.6/319 |

TABLE I-continued

| Example | Coating Solution (w/w %) | Heat Strengthened Yarn Properties T/E/M (gpd/%/gpd) |
|---|---|---|
| 2 | 1% KI, 0.1% Igepal ® CO630 | 22.5/3.6/493 |
| — | 0.1% Alkanol ® OJ | 4.1/1.3/272 |
| 3 | 1% KI, 0.1% Alkanol ® OJ | 21.4/3.5/490 |
| — | 0.1% Zonyl ® FSN | 5.9/1.7/290 |
| 4 | 1% KI, 0.1% Zonyl ® FSN | 21.2/3.4/505 |

EXAMPLE 5

A portion of a 10-filament yarn of about 60 denier spun from a polymer with the same composition as Examples 1–4 was immersed in an aqueous solution containing 1.45% by weight dipotassium terephthalate and 0.1% by weight Triton ®X-100. Control samples were made by immersing another portion of the yarn in a 1.45% dipotassium terephthalate solution without surfactant. After the yarns were soaked for 20 minutes, they were withdrawn from the solution and allowed to dry at room temperature. The yarn which was treated with a solution containing Triton ®X-100 heat strengthened (following the procedure of Examples 1–4) to a much higher tenacity than the control yarn (see Table II).

EXAMPLE 6

A portion of the 10-filament yarn from Example 5 was immersed in an aqueous solution containing 1.4% by weight potassium laurate and 0.1% by weight Triton ®X-100. Control samples were made by immersing another portion of the yarn in a 1.4% potassium laurate solution without surfactant. The yarn which was treated with the solution containing Triton ®X-100 heat strenghened (following the procedure of Examples 1–4) to a much higher tenacity than the control yarn (see Table II).

TABLE II

| Example | Coating Solution (w/w % in deionized water) | Heat Strengthened Yarn Properties T/E/M (gpd/%/gpd) |
|---|---|---|
| 5 | 1.45% dipotassium terephthalate | 11.8/2.4/444 |
| | w. 0.1% Triton ® X-100 | 26.8/4.0/485 |
| 6 | 1.4% potassium laurate | 14.6/2.5/567 |
| | w. 0.1% Triton ® X-100 | 21.0/3.4/501 |

EXAMPLE 7

A sample of the 10-filament yarn (used in Example 5) was immersed in an aqueous solution containing 1% Aerosol ®OT-75 (an ionic surfactant containing dioctyl ester of sodium sulfosuccinic acid salt). Untreated yarn was used as a control. The solution-treated yarn heat strengthened (following the procedure of Examples 1–4) to a much higher tenacity than the control yarn with T/E/M (gpd/%/gpd) of 21.3/3.6/473 vs. 4.7/1.5/282.

We claim:

1. In a process for heat-strengthening yarn spun from optically anisotropic melt-forming polyesters wherein the yarn is coated with a solution of a heat-strengthening accelerator comprising an alkali metal salt and then heated at temperatures above 250° C. for a period sufficient to increase tenacity by at least 50%, the improvement comprising incorporating a sufficient amount of a surfactant in the solution of the accelerator which will cause the accelerator to become more effective.

2. The process of claim 1 wherein the surfactant is non-ionic.

3. The process of claim 1 wherein the alkali metal salt is potassium iodide.

4. In a process for accelerating the heat-strengthening of yarn spun from optically anisotropic melt-forming polyesters wherein the yarn is coated with a heat-strengthening accelerator and is heated to temperatures above 250° C. for a period sufficient to increase tenacity by at least 50%, the improvement comprising enhancing acceleration of the heat-strengthening process by coating said yarn prior to such heat-treatment with a small amount of an ionic surfactant containing an alkali metal ion, the metal ion acting as a heat-strengthening accelerator.

* * * * *